United States Patent [19]

Johnson

[11] 4,009,529

[45] Mar. 1, 1977

[54] GRADING BLADE FOR A TOOTHED SHOVEL

[76] Inventor: Lawrence M. Johnson, 3594 S. Sand Creek Road, Decatur, Ill. 62521

[22] Filed: Sept. 25, 1975

[21] Appl. No.: 616,657

[52] U.S. Cl. ..... 37/117.5; 37/141 R; 172/719; 294/51

[51] Int. Cl.[2] ..... E02F 3/76; E02F 3/81

[58] Field of Search ..... 37/118 R, 117.5, 141 R, 37/142.5, 103; 172/719; 214/145 R; 294/51

[56] References Cited

UNITED STATES PATENTS

| | | | |
|---|---|---|---|
| 596,120 | 12/1897 | Oueson | 294/51 |
| 707,948 | 8/1902 | Spillane | 294/51 |
| 2,969,966 | 1/1961 | Matheis | 37/141 R |
| 3,043,032 | 7/1962 | Discenza | 37/117.5 |
| 3,523,380 | 8/1970 | Bolyard et al. | 37/142.5 X |

FOREIGN PATENTS OR APPLICATIONS

| | | | |
|---|---|---|---|
| 522,305 | 3/1956 | Canada | 37/117.5 X |
| 1,095,756 | 5/1958 | Germany | 37/141 R |

OTHER PUBLICATIONS

"This Tricky Rig Helps Win More Bids" Construction Methods & Equipment, Oct. 1960, p. 82 Middle Figure, G. H. Tague.

*Primary Examiner*—Edgar S. Burr
*Assistant Examiner*—Steven A. Bratlie

[57] ABSTRACT

A grading blade for attachment to a toothed shovel, such as a backhoe bucket, without modificiation of the bucket. The blade includes a pair of upstanding side portions adapted to direct spillover inwardly, toward the bucket. The blade is tapered at its sides to permit it to be used closely adjacent the foundation of a building.

4 Claims, 4 Drawing Figures

20
22
24
28
30
36
40
42
46
48
54
56
58
59
60
61
62
64
66
68
70
72
78
80
82
84
86
88
90
92

20
22
24
28
32
36
40
42
46
48
54
56
58
59
60
62
66
68
70
72

GRADING BLADE FOR A TOOTHED SHOVEL

BACKGROUND OF THE INVENTION

1. Field of the Invention

The invention relates to attachments for toothed shovels and, more particularly, to a grading blade which may be readily fitted to a conventional backhoe bucket without modification of the backhoe bucket.

2. Description of the Prior Art

Prior art attachments for toothed shovels commonly comprise a flat plate adapted to be slipped over the teeth of a backhoe bucket and to be retained thereon by means of specially designed attachment fittings. Since the buckets are of differing designs, the fittings must be adapted to each bucket design. Quite commonly, the buckets or their teeth must be specially modified to accept the attachment. This, of course, greatly increases the expense of a given attachment.

Prior art grading blades also are quite large and unwieldy. As a consequence, they are difficult to attach to the backhoe bucket and often require the cooperation of two or more men. Because of the manner of attachment, and modifications made to the buckets, and the weight of the prior art attachment blades, undue strain is placed on the teeth of the backhoe bucket. In turn, failure of the teeth or the attachment fittings is a common occurrence. As a result, the time and expense needed to satisfactorily complete a given grading job is increased. Further, the operator of a backhoe employing prior art grading devices must be extremely skillful and cautious in order to prevent premature failure of the teeth or fittings.

Since prior art grading blades most commonly are flat plates, no provision is made for spillover of dirt during a grading operation. As a result, many passes of the blade are necessary before the job may be completed satisfactorily. In turn, the time and expense of the operation is increased.

Additionally, because of the shape of the prior art devices, the grading operation cannot be continued to a point closely adjacent to a building having weatherboarding or the like overhanging the foundation. If the operator should attempt to employ the blade close to such a building, damage to the building is quite likely. Therefore, the operator must refrain from employing the grading blade close to the building and the job must be completed manually. This entails additional time and expense.

Accordingly, it is an object of the invention to provide a new and improved grading blade attachment for a toothed shovel which can easily be fitted to a conventional backhoe bucket without modification of the bucket.

It is another object of the invention to provide a new and improved grading blade attachment for a toothed shovel wherein undue strain on the teeth of the shovel or on the attachment fittings is avoided.

It is yet another object of the invention to provide a new and improved grading blade attachment for a toothed shovel wherein dirt being graded is contained within the shovel so as to prevent spillover of the dirt and thus permit the operator to do a neater job with fewer passes.

It is a still further object of the invention to provide a new and improved attachment for a toothed shovel wherein the attachment is shaped so as to permit the operator to employ the attachment adjacent a building, even if the building has weatherboarding overhanging the foundation.

SUMMARY OF THE INVENTION

In carrying out the invention, in one form thereof, the grading blade attachment for a toothed shovel comprises a blade member adapted to be retained on the teeth of a conventional backhoe bucket without modification of the bucket. The grading blade attachment also comprisies a clamping member extending outwardly thereof. The clamping member and blade member are adapted to engage the teeth of the shovel therebetween. To securely lock the blade on the shovel, the grading blade includes a plate member rigidly affixed thereto, which engages an upstanding portion of the teeth. The grading blade attachment is attached to the shovel by means of fasteners engaging the blade member and the clamping member, and extending between the teeth of the bucket. The blade member is tapered at its sides to a width approximately that of the shovel to permit the blade to clear weatherboarding extending outwardly of the building and thus to permit a grading operation adjacent the building. Attached to the blade member is a pair of upstanding side portions which direct dirt being graded inwardly, toward the interior of the bucket, to prevent spillover.

DESCRIPTION OF THE PREFERRED EMBODIMENT

Figure 1:
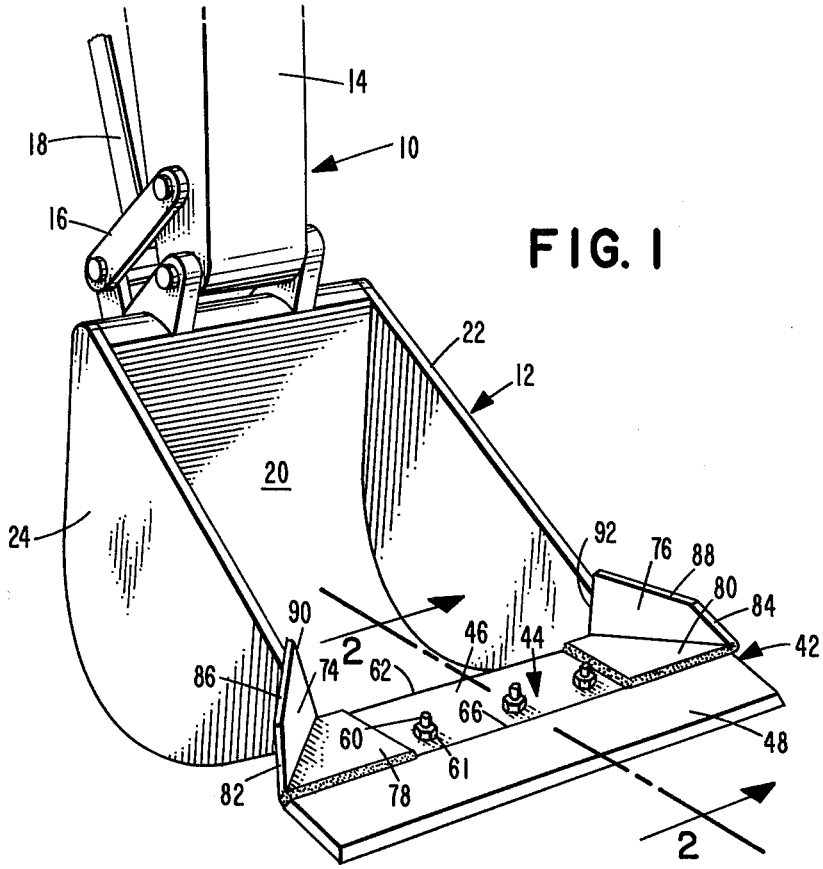
FIG. 1 is a perspective view of a preferred embodiment of the grading blade invention, affixed to a conventional toothed backhoe shovel.

FIG. 1 shows a backhoe 10 having a conventional backhoe bucket, or toothed shovel 12 which is hingeably mounted to a dipstick 14 by a bucket linkage 16, and is actuated by a hydraulic ram 18. The structure and advantages of the invention are particularly well-suited for use with backhoe buckets, although the invention is equally well-suited for use with other toothed shovels, such as bulldozer blades.

Figure 2:
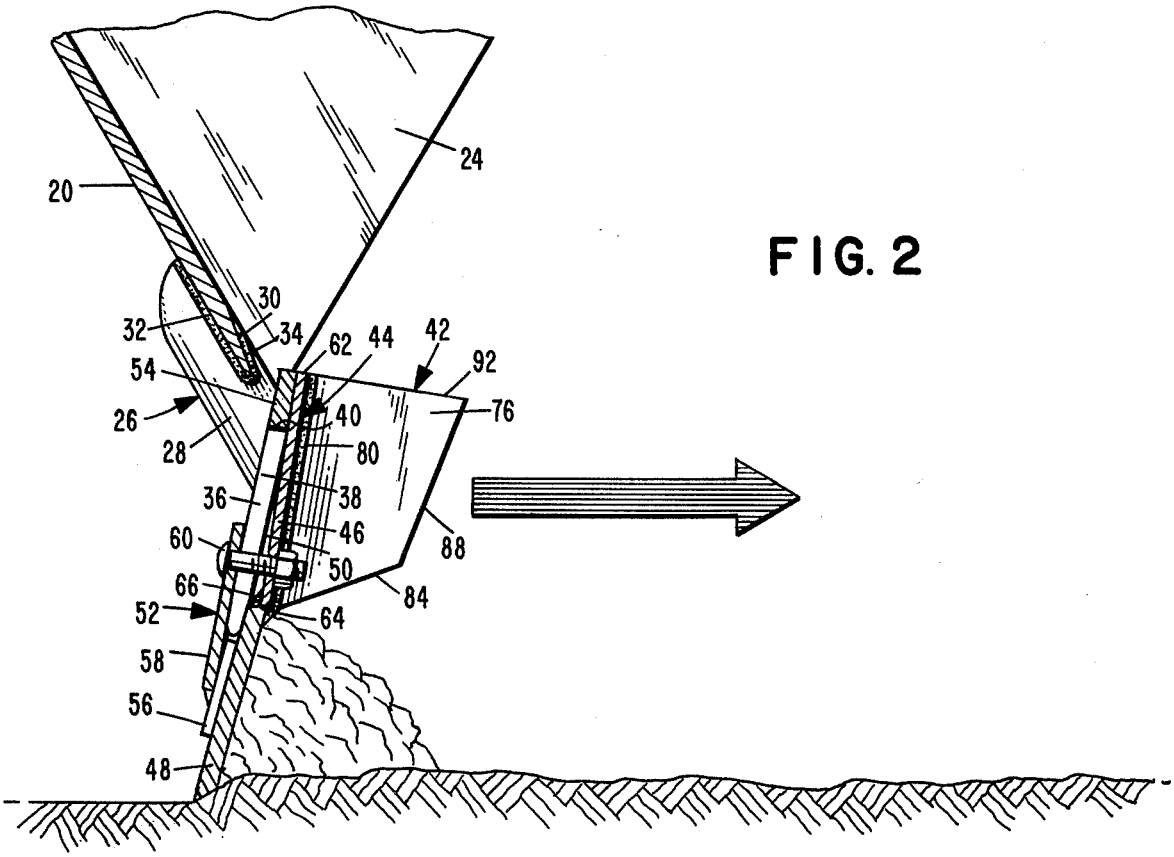
FIG. 2 is a cross-sectional view taken along line 2–2 of FIG. 1 showing the grading blade attachment and shovel of FIG. 1 employed in a grading operation.
Figure 3:
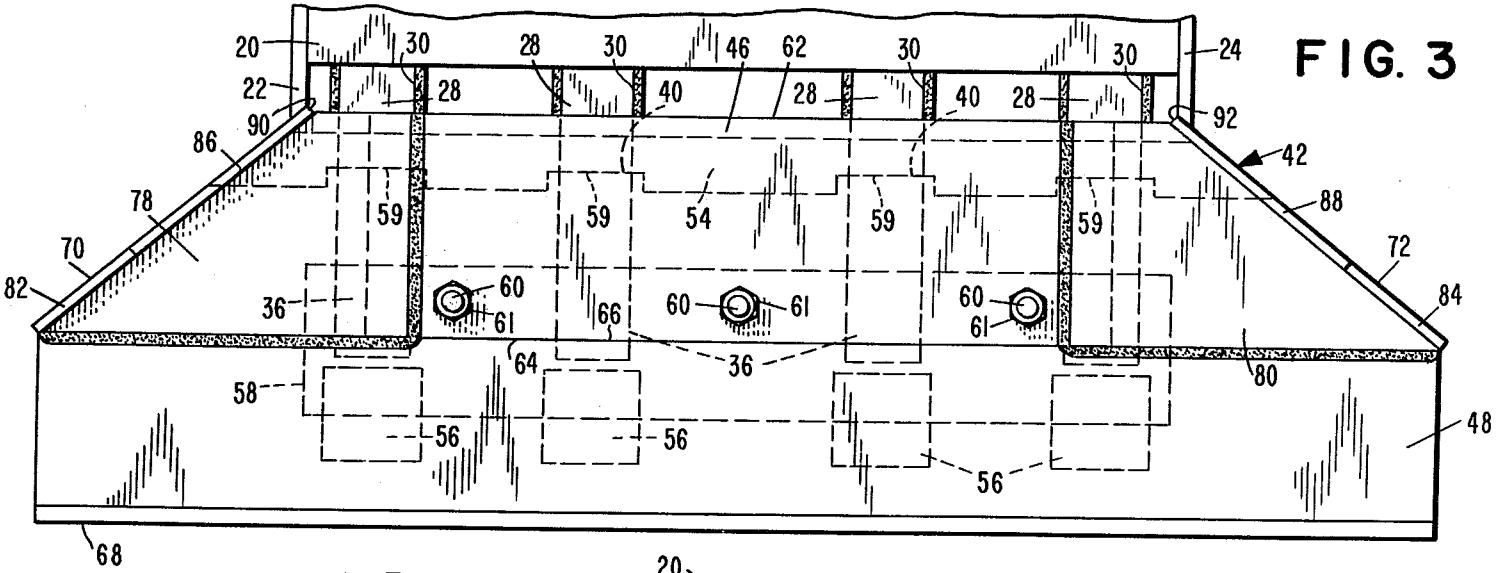
FIG. 3 is a front elevational view, partly in section, of the invention of FIG. 1.
Figure 4:
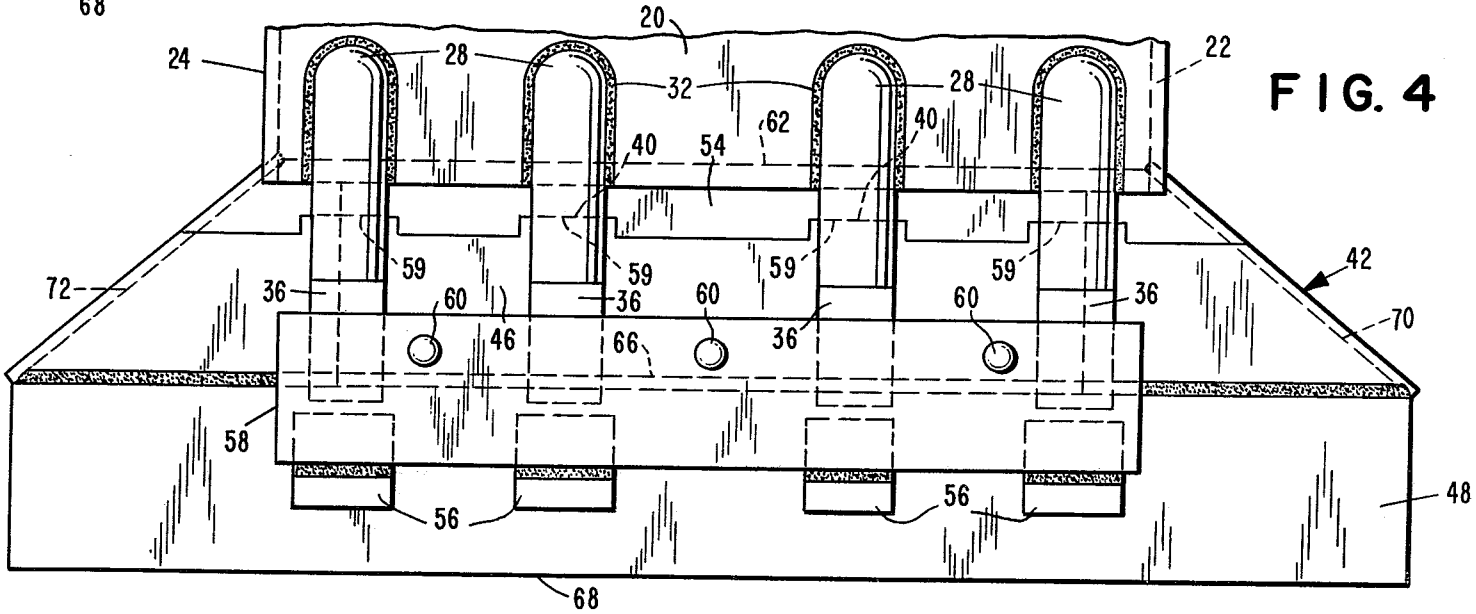
FIG. 4 is a rear elevational view, partly in section, of the invention of FIG. 1.

Shovel 12 includes curved, central portion 20 having sidewalls 22 and 24 affixed thereto. As shown by FIGS. 2, 3, and 4, shovel 12 includes a plurality of teeth 26 extending outwardly thereof. In a conventional toothed shovel, teeth 26 are identical. As illustrated, shovel 12 includes four teeth extending outwardly thereof, although certain conventional toothed shovels are provided with five teeth. The attachment of the present invention may be fitted to any conventional toothed shovel, however, regardless of the number of teeth provided with the shovel.

Each tooth 26 comprises a base portion 28 rigidly affixed to the forward edge of central portion 20. Base portion 28 includes a slot 30, into which the leading edge of central portion 20 extends. Tooth 26 is welded, as at 32 and 34, to edge 20. Tooth 26 also comprises a replaceable cap portion 36, which is attached to front surface 38 of base portion 28 by means of bolts, rivets, or welds (not illustrated). Cap portion 36 terminates at its inward end in a shoulder 40, upstanding from front surface 38. All of these elements are found on a conventional toothed backhoe bucket.

The present invention comprises a grading blade attachment 42 fitted to teeth 26 of shovel 12. Attachment 42 normally is made of steel, although any well known structural material having sufficient strength and wearing properties will suffice. Attachment 42 comprises a blade member 44 which, in turn, is comprised of planar, generally trapezoidal blade member 46 and planar, generally rectangular blade member 48. Blade member 44 is adapted to be fitted over the top surfaces 50 of caps 36, and to be retained thereon by the action of clamping member 52 and plate member 54. Clamping member 52 includes at least one first spacer plate 56 rigidly affixed to the underside of rectangular blade member 48, as by welding. In turn, clamping member 52 includes a second plate 58 rigidly affixed to the underside of plates 56, as by welding. It is seen that clamping member 52 thus extends outwardly of rectangular blade member 48 and is adapted to engage cap 36 of tooth 26 between plate 58 and trapezoidal blade member 46 and rectangular blade member 48.

To assist in retaining trapezoidal blade member 46 and rectangular blade member 48 on the shovel, plate member 54 is rigidly affixed to the underside of trapezoidal blade member 46, as by welding. As best shown by FIG. 2, plate member 54 engages upstanding shoulder 40. To prevent shifting of the attachment, plate member 54 includes at least one notch 59, which notch is fitted about cap 36. This is best illustrated by FIGS. 3 and 4.

A plurality of bolts 60 having nuts 61 extend through clamping member 52 and trapezoidal blade member 46 so that, upon tightening nuts 61, cap 36 is firmly engaged therebetween. Any number of fasteners may be employed so long as the blade-shovel attachment is secure. Additionally, any type of fastener may be employed, although bolted fasteners are illustrated. Fasteners 60 extend between adjacent teeth.

The shortest parallel side 62 of generally trapezoidal blade member 46 is approximately the width of shovel 12 at that point where blade member 46 extends outwardly of shovel 12. The longer parallel side 64 of blade member 46 abuts the longer side 66 of generally rectangular blade member 48 and is rigidly connected thereto, as by welding. As shown in FIG. 2, blade members 46 and 48 substantially are in the same plane, although this is not necessary. The other longer side 68 of blade member 48 is beveled in order to provide a cutting edge for better grading the dirt.

The shorter, nonparallel sides 70 and 72 of blade member 46 taper inwardly from approximately the width of blade member 48 to approximately the width of shovel 12. A pair of upstanding side portions 74 and 76 are provided, side portion 74 being rigidly affixed to blade member 46 adjacent nonparallel side 70, and upstanding side portion 76 being rigidly affixed to blade member 46 adjacent nonparallel side 72. Upstanding side portions 74 and 76 include a pair of support pieces 78 and 80, which support pieces are rigidly affixed to blade member 46, as by welding. Upstanding side portions 74 and 76 also include tapered leading edges 82 and 84, tapered top edges 86 and 88, and trailing edges 90 and 92. The precise shape of side portions 74 and 76 is not critical to the invention, so long as most of any excess dirt spills into shovel 12.

To attach the grading blade to the shovel, the blade 42 is first laid on the ground face up as shown in FIG. 1. Shovel 12 then is maneuvered so that teeth 26 are inserted behind attachment 42 and into the space between clamping member 52 and blade member 44 so that plate 54 engages upstanding caps 36 at shoulder 40. Thereafter, fasteners 60 are actuated to firmly clamp teeth 26 between clamping member 52 and blade member 44 and thus retain the grading blade firmly on the shovel. The grading blade is now ready for service.

Because the nuts 61 on fasteners 60 are on the upper surface of blade member 46, they may be actuated conveniently. It is possible for the operator to mount and demount the grading blade by himself with no difficulty. This is a considerable advantage over prior art devices which require the combined efforts of two or more men to connect the grading attachment to the shovel. Because blade member 44 is disposed on the top surface of teeth 26, no wearing of the teeth occurs during a grading operation, thus extending the usable life of the teeth. Plate member 54 with notches 59 therein effectively prevents shifting of the attachment with respect to the teeth and assists clamping member 52 in retaining the attachment on the shovel. As a result, stresses applied to teeth 26 are better distributed and failure of the teeth or of the attachment fittings is much less likely to occur than in prior art devices. Due to upstanding side portions 74 and 76, any spillover dirt is directed into shovel 12, thus permitting the operator to move more dirt with fewer passes than in prior art devices. Additionally, because of tapered, nonparallel sides 70 and 72, the attachment may be employed adjacent a building, even one having weatherboard, since tapered sides 70 and 72 cannot interfere with the weatherboard, unlike prior art rectangular grading blades. Due to the unique nature of clamping member 52 and notched plate 54, attachment 42 can be employed with any conventional toothed shovel and thus represents a distinct advantage over prior art devices not having this capability. Furthermore, it is apparent that attachment 42 is very light and compact, which by itself results in less stresses being applied to teeth 26 or shovel 12 than in prior art devices which are considerably heavier and more unwieldy. As a consequence, a less-experienced operator can rapidly and efficiently perform a superior job. Furthermore, the back side of the grading blade can also be used to grade away from the direction indicated in FIG. 2. Substantial loads may also be placed upon the device in this direction, because such loads are received not only at fasteners 60, but also at plate member 54. Plate member 54 is spaced approximately the same distance from fasteners 60 as is edge 68, and thus has an equal moment arm upon which to distribute the load. This feature is not present in prior art devices.

While a specific embodiment of the invention has been described, it will be obvious to those skilled in the art that changes and modifications may be made without departing from the invention. It is, therefore, intended in the appended claims to cover all such changes and modifications that fall within the true spirt and scope of the invention.

I claim:

1. A grading blade attachment for a backhoe shovel or the like having a plurality of outwardly extending spaced teeth, each of said teeth having a raised portion on the upper surface thereof, said blade attachment comprising:

a substantially planar trapezoidal first blade member having a short parallel edge of width substantially equal to the width of said shovel, a long parallel edge, and a pair of opposed converging side edges, a substantially planar rectangular second blade member rigidly affixed to said long parallel edge of said first blade member and extending outwardly thereof, said second blade member terminating in a scraping edge substantially parallel to said parallel edges, a pair of upstanding side portions, one of said side portions being attached to said first blade member along each of said nonparallel edges and extending upwardly substantially perpendicular to said first blade member, means for attachment of said blade attachment to said shovel without modification of said shovel consisting essentially of, a clamping member attached to the underside of said second blade member to define therebetween an opening for receiving the end portions of said teeth, said clamping member being so located as to position said attachment such that said short parallel edge and said side portions are in juxtaposition to the respective edges of said shovel when said end portions of said teeth are in said opening, a plate member attached to the underside of said first blade member, said plate member having a plurality of notches for receiving the teeth of said shovel, each of said notches being defined at least in part by a shoulder oriented substantially perpendicular to said short parallel edge and engageable with the raised portion of said teeth when said teeth extend into said opening, and a plurality of threaded bolts extending through the holes provided in said first blade member and said clamping member and passing through the spaces between said teeth, said bolts being secured by nuts installed thereon to fasten said grading blade attachment to said shovel.

2. The grading blade attachment of claim 1 wherein said side portions increase in height from said long parallel edge toward said short parallel edge and extend only along said first blade member.

3. The grading blade attachment of claim 1 further comprising a plurality of spaced spacer plates attached to the underside of said second blade member, said clamping member being attached to said spacer plates.

4. The grading blade attachment of claim 1 wherein the distance between said scraping edge and said bolts is of the same general magnitude as the distance between the said bolts and said short parallel edge.

* * * * *